US007483542B2

(12) United States Patent
Akino et al.

(10) Patent No.: US 7,483,542 B2
(45) Date of Patent: Jan. 27, 2009

(54) CONDENSER MICROPHONE

(75) Inventors: Hiroshi Akino, Machida (JP); Shioto Okita, Machida (JP); Noriko Matsui, Machida (JP)

(73) Assignee: Kabushiki Kaisha Audio-Technica, Machida-Shi, Tokyo (JP)

( * ) Notice: Subject to any disclaimer, the term of this patent is extended or adjusted under 35 U.S.C. 154(b) by 418 days.

(21) Appl. No.: 11/208,627

(22) Filed: Aug. 23, 2005

(65) Prior Publication Data

US 2006/0045302 A1 Mar. 2, 2006

(30) Foreign Application Priority Data

Aug. 31, 2004 (JP) ..... 2004-251656

(51) Int. Cl.
*H04R 25/00* (2006.01)
*H04R 11/04* (2006.01)

(52) U.S. Cl. ..... 381/189; 381/174; 381/363; 381/361

(58) Field of Classification Search ..... 381/91, 381/94.6, 189, 174, 355, 361; 439/497, 610
See application file for complete search history.

(56) References Cited

U.S. PATENT DOCUMENTS

| | | | | |
|---|---|---|---|---|
| 3,646,496 | A * | 2/1972 | Williams | 439/462 |
| 4,002,859 | A * | 1/1977 | Schoeps et al. | 381/113 |
| 4,025,145 | A * | 5/1977 | Shaffer et al. | 439/610 |
| 4,491,697 | A * | 1/1985 | Tanaka et al. | 381/113 |
| 4,634,208 | A * | 1/1987 | Hall et al. | 439/610 |
| 4,929,189 | A * | 5/1990 | Sekiguchi | 439/352 |
| 5,151,053 | A * | 9/1992 | Shinji et al. | 439/610 |
| 5,597,322 | A * | 1/1997 | Inaba et al. | 439/578 |
| 5,707,253 | A * | 1/1998 | Matsumoto et al. | 439/610 |
| 6,226,386 | B1 * | 5/2001 | Akino | 381/173 |
| 6,643,380 | B2 * | 11/2003 | Rodemer | 381/369 |

FOREIGN PATENT DOCUMENTS

| | | | |
|---|---|---|---|
| EP | 0077615 | A1 * | 4/1983 |
| GB | 2337878 | A * | 12/1999 |

OTHER PUBLICATIONS

Gayford, Michael; "Microphone Engineering Handbook"; Butterworth-Heinemann Ltd 1994; p. 57.*
IEEE guide on shielding practice for low voltage cables, IEEE Std 1143-1994 , pp. 5-24, Apr. 13, 1995.*

* cited by examiner

*Primary Examiner*—Suhan Ni
*Assistant Examiner*—Ryan C Robinson
(74) *Attorney, Agent, or Firm*—Manabu Kanesaka

(57) ABSTRACT

In a condenser microphone unit connected to an output module section via a dedicated microphone cord, the generation of noise caused by strong electromagnetic waves sent from a cellular phone etc. is effectively prevented by a simple configuration. In the condenser microphone unit in which a microphone capsule 10 is supported, for example, exchangeably on a support enclosure 20 and a microphone cord 30 consisting of a two-core shield covering line for connecting the condenser microphone unit to the output module section is pulled into the support enclosure 20, a shield covering line exposure portion 33*a*, in which a shield covering line 33 is stripped off, is provided in a portion in which the microphone cord 30 is pulled into the support enclosure 20, and a fixing member 40 formed into a doughnut shape is fixed to the shield covering line exposure portion 33*a* by staking, by which the shield covering line 33 is connected to the support enclosure 20 via the fixing member 40.

6 Claims, 2 Drawing Sheets

CONDENSER MICROPHONE

TECHNICAL FIELD

The present invention relates to a condenser microphone in which a condenser microphone unit and an output module section having an audio output circuit are connected to each other via a dedicated microphone cord. More particularly, the present invention relates to a technique for preventing the generation of noise caused by electromagnetic waves applied to the microphone cord.

BACKGROUND ART

For a gooseneck microphone used for conference and a tie clip microphone used by being attached to clothes among condenser microphones, a microphone unit and an output module section having an audio output circuit are separated from each other, and are connected to each other via a dedicated microphone cord. FIG. 3 is a sectional view showing a configuration on the microphone unit side of these two elements.

The microphone unit includes a microphone capsule 10 and a support enclosure 20 as a basic configuration. Although the microphone capsule 10 is exchangeably supported on the support enclosure 20 in this example, in some microphone unit, the microphone capsule 10 and the support enclosure 20 are integrated with each other.

The microphone capsule 10 has a cylindrical housing 11 made of, for example, a brass material. In the housing 11, a diaphragm 12 stretchedly provided on a support ring 13 and a backplate 14 supported on an insulating seat 15 are contained in a state of being arranged so as to face to each other via an electrical insulating spacer (not shown).

The back surface side of the housing 11 is closed by a back cover 16, and a contact pin 17, which is connected to the backplate 14 via a not illustrated wiring, protrudes from the back cover 16. Also, on the back surface side of the housing 11, a connection screw 18 for connecting the housing 11 to the support enclosure 20 is fixed so as to provide electrical continuity with the housing 11.

The support enclosure 20 is formed into a cylindrical shape by, for example, a brass material, and on one end side (upper end side in FIG. 3) thereof, a circuit board 21 is arranged so as to close the interior of the enclosure. On the circuit board 21, a field effect transistor (FET) 22 serving as an impedance converter is mounted. Although not shown in the figure, the circuit board 21 is formed with lead wires for electrodes of gate, drain, and source of the FET 22. The circuit board 21 is a double-sided circuit board, and at least the gate lead wire is pulled out to the top surface side of the circuit board 21 via a wire in a through hole.

On the circuit board 21, a contact terminal 23 consisting of a plate spring that is in contact with the contact pin 17 is mounted in a state of being held on a spacer 24 consisting of a rubber elastic element. The lower end of the contact terminal 23 is in contact with the gate lead wire of the FET 22. Therefore, when the microphone capsule 10 is connected to the support enclosure 20, the backplate 14 is connected to the gate of the FET 22 via the contact pin 17 and the contact terminal 23.

On the other end side (lower end side in FIG. 3) of the support enclosure 20, a cord introduction hole 25 having a cord bush 26 is provided, and a microphone cord 30 extending from this cord introduction hole 25 toward the output module section (not shown) side is pulled into the support enclosure 20. In the case of the gooseneck microphone, the microphone cord 30 is allowed to pass through a support pipe including a flexible pipe.

As the microphone cord 30, a two-core shield covering line is used which includes power line for supplying power to the microphone capsule 10, a signal line for sending an audio signal generated from the FET 22 to the output module section, not shown, and a shield covering line for electrostatically shielding and grounding the power line and signal line.

In a portion in which the microphone cord 30 is pulled into the support enclosure 20, a knot 30*a* for preventing the cord 30 from coming off is made, and for example, the power line is soldered to the gate lead wire of the FET 22, the signal line to the drain lead wire thereof, and the shield covering line to the source lead wire thereof. The source lead wire is laid out at the peripheral edge of the circuit board 21, and is brought into contact with the support enclosure 20.

Electromagnetic waves applied to the microphone cord 30 (a noise source for the microphone) are more or less shielded by the shield covering line. However, since the shield covering line of the microphon cord 30 is pulled into the support enclosure 20 together with the power line and signal line, the electromagnetic waves applied to the microphone cord 30 intrude into the support enclosure 20, and are detected by the FET 22, so that noise is sometimes generated.

In recent years, cellular phones have come into wide use rapidly. In the case where a cellular phone is used in the immediate vicinity of a microphone, the microphone receives considerably strong electromagnetic waves (for example, in the range of several centimeters to several tens centimeters, field intensity reaching several ten thousands times of intensity of field generated in the city by commercial electric waves), so that measures against cellular phones are a pressing need in the field of microphone.

As one method for answering the need, a technique in which, for example, in a gun microphone in which the microphone unit is housed in a housing cylinder consisting of a conductor, the microphone unit is connected (grounded) to the housing cylinder consisting of a conductor at the shortest distance has been proposed in Japanese Patent Application Publication No. 2001-103591.

However, although being effective for the gun microphone or the like, this method cannot be applied to a microphone in which, as in the conventional example, the microphone capsule and the output module section are separated from each other and are connected to each other via the microphone cord.

SUMMARY OF THE INVENTION

Accordingly, a problem of the present invention is that in a condenser microphone unit connected to an output module section via a dedicated microphone cord, the generation of noise caused by strong electromagnetic waves sent from a cellular phone etc. is effectively prevented by a simple configuration.

To solve the above problem, the present invention provides a condenser microphone in which there is provided a condenser microphone unit which is connected to an output module section having an audio output circuit via a microphone cord consisting of a two-core shield covering line, the condenser microphone unit including a microphone capsule, which contains a diaphragm and a backplate arranged so as to face to each other in a cylindrical housing, and a cylindrical metallic support enclosure, which supports the microphone capsule on one end side and has a cord introduction hole on the other end side; in the support enclosure, a circuit board on which an impedance converter electrically connected to the backplate via a predetermined conducting means is mounted is provided; and one end of the microphone cord is pulled into the support enclosure through the cord introduction hole and is connected to the circuit board, wherein the microphone cord is provided with a shield covering line exposure portion, in which a shield covering line is stripped off, in a portion in which the microphone cord is pulled into the support enclosure, and an annular fixing member having a diameter larger than that of the cord introduction hole is provided in the support enclosure, the inner periphery side of the fixing member being fixed to the shield covering line exposure portion, and the outer periphery side thereof being connected electrically to the internal surface of the support enclosure According to this configuration, the shield covering line of the microphone cord is surely connected to the support enclosure by the fixing member in the vicinity of the cord introduction hole through which the microphone cord is pulled into the support enclosure, and hence a high-frequency current caused by electromagnetic waves applied to the microphone cord flows to the support enclosure side, so that the generation of noise caused by the electromagnetic waves is prevented.

Also, it is preferable that the shield covering line be removed in a forward portion of the shield covering line exposure portion of the microphone cord.

According to this configuration, since the shield covering line is removed in a forward portion of the shield covering line exposure portion of the microphone cord, electromagnetic waves can surely be prevented from intruding into the support enclosure.

As a more favorable mode, on the inner periphery side of the fixing member, a staking sleeve, through which the shield covering line exposure portion is inserted and which is fixed to the shield covering line exposure portion by plastic deformation, is formed integrally.

As another mode, it is preferable that in the support enclosure, a washer be arranged which frictionally engages with the internal surface of the support enclosure and fixes the fixing member so as to press the fixing member. Further, it is preferable that internal threads be formed in the internal surface of the support enclosure, and external threads threadedly engaging with the internal threads be formed in the outer peripheral surface of the fixing member, by which the fixing member is screwed in the support enclosure.

According to these configurations, since the fixing member is surely fixed in the support enclosure, the microphone cord can withstand any stress in the pulling-out, pressing, and rotating directions applied to the microphone cord, so that a fixation state with high reliability of microphone cord can be obtained.

DETAILED DESCRIPTION

Figure 1:
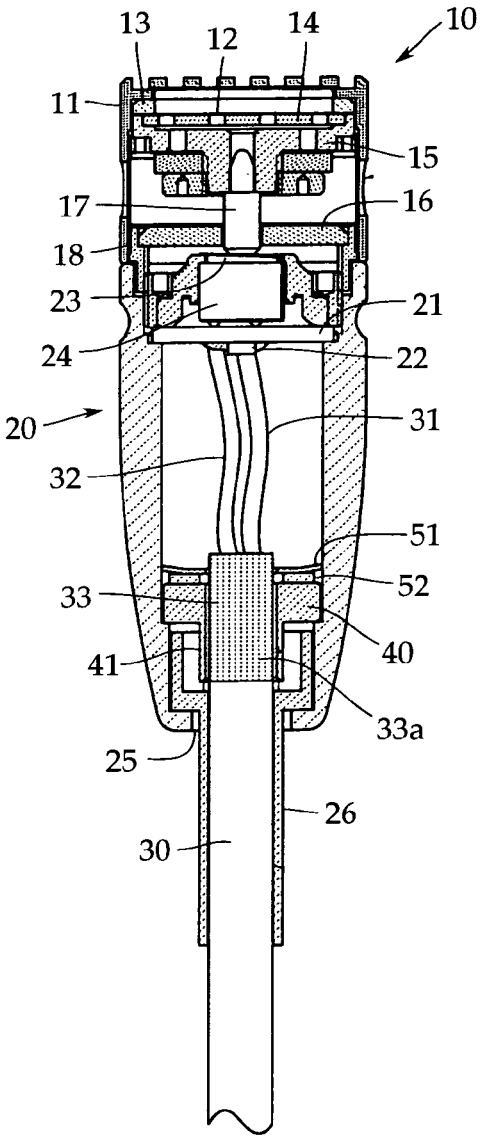
FIG. 1 is a sectional view showing one example of a condenser microphone unit in accordance with the present invention.
Figure 2:
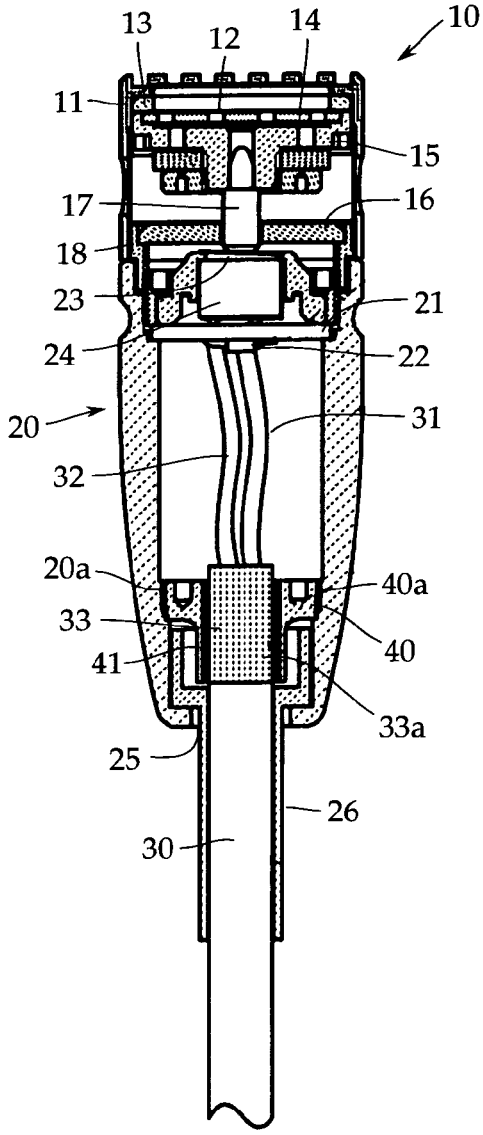
FIG. 2 is a sectional view showing another example of a condenser microphone unit in accordance with the present invention.
Figure 3:
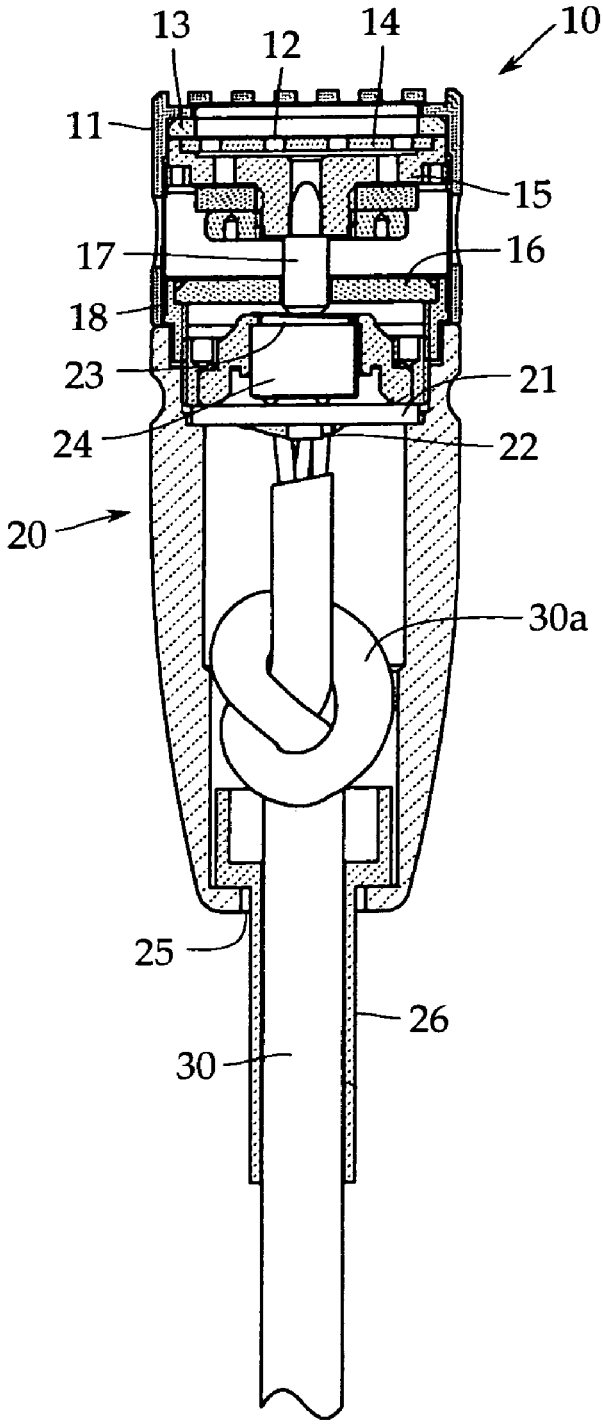
FIG. 3 PRIOR ART
FIG. 3 is a sectional view of a condenser microphone unit in a conventional example.

An embodiment of the present invention will now be described with reference to FIGS. 1 and 2. The present invention is not limited to the embodiment described below. FIG. 1 is a sectional view showing one example of a condenser microphone unit in accordance with the present invention, and FIG. 2 is a sectional view showing another example thereof. In FIGS. 1 and 2, the same reference numerals are applied to elements that are the same or regarded as the same as the elements in the conventional example explained before with reference to FIG. 3, and explanation is sometimes replaced with the reference numeral.

A condenser microphone in accordance with the present invention includes a microphone unit and an output module section that are connected to each other via a microphone cord. FIGS. 1 and 2 show only the microphone unit side of these elements as in the case of FIG. 3. The output module section is provided with at least an audio output circuit, and the power source may be a phantom power source or a battery.

Referring to FIG. 1, the condenser microphone unit in accordance with the present invention includes, as a basic configuration, a microphone capsule 10 and a support enclosure 20 supporting the microphone capsule 10.

In the present invention, the configuration of the microphone capsule 10 may be the same as that explained before with reference to FIG. 3, but the microphone capsule 10 need not be detachable (exchangeable) from the support enclosure 20 and may be integral with the support enclosure 20. Regarding the directivity, there is no special need.

As in the conventional example explained before with reference to FIG. 3, the support enclosure 20 is formed into a cylindrical shape by, for example, a brass material, and on the one end side (upper end side in FIG. 1) thereof, a circuit board 21 is arranged so as to close the interior of the enclosure.

On the circuit board 21, an FET 22 serving as an impedance converter is mounted. Although not shown in the figure, the circuit board 21 is formed with lead wires for electrodes of gate, drain, and source of the FET 22. The circuit board 21 is a double-sided circuit board, and at least the gate lead wire is pulled out to the top surface side of the circuit board 21 via a wire in a through hole.

On the circuit board 21, a contact terminal 23 consisting of a plate spring that is in contact with a contact pin 17 is mounted in a state of being held on a spacer 24 consisting of a rubber elastic element. The lower end of the contact terminal 23 is in contact with the gate lead wire of the FET 22. Therefore, when the microphone capsule 10 is connected to the support enclosure 20, a backplate 14 is connected to the gate of the FET 22 via the contact pin 17 and the contact terminal 23.

On the other end side (lower end side in FIG. 1) of the support enclosure 20, a cord introduction hole 25 having a cord bush 26 is provided, and a microphone cord 30 extending from this cord introduction hole 25 toward the output module section (not shown) side is pulled into the support enclosure 20. In the case of the gooseneck microphone, the microphone cord 30 is allowed to pass through a support pipe including a flexible pipe.

As the microphone cord 30, a two-core shield covering line is used which includes power line 31 for supplying power to the microphone capsule 10, a signal line 32 for sending an audio signal generated from the FET 22 to the output module section, not shown, and a shield covering line 33 for electrostatically shielding and grounding the power line and signal line.

According to the present invention, in a portion in which the microphone cord 30 is pulled into the support enclosure 20, a shield covering line exposure portion 33*a*, in which the shield covering line 33 is stripped off, is provided, and a fixing member 40 is fixed in the shield covering line exposure portion 33*a*.

In this example, a skin on the front end side on which the microphone cord 30 is connected to the circuit board 21 is removed to strip off the shield covering line 33, and the stripped-off shield covering line 33 is folded to form the shield covering line exposure portion 33*a*.

According to this configuration, the shield covering line 33 is not present in a forward portion of the shield covering line exposure portion 33*a*, so that this configuration is favorable in preventing electromagnetic waves from intruding into the support enclosure 20. Only a skin in a portion in which the fixing member 40 is fixed may be removed to form the shield covering line exposure portion 33*a*.

In the example shown in FIG. 1, the fixing member 40 is formed as a thick washershaped (doughnutshaped) annular element having a diameter larger than that of the cord introduction hole 25, and the outside diameter thereof has a size such that the fixing member 40 is in contact with the internal surface of the support enclosure 20. Also, on the inner periphery side thereof on which the microphone cord 30 passes through the fixing member 40, a staking sleeve 41, which is fixed to the shield covering line exposure portion 33*a* by plastic deformation, is formed integrally.

As the material for the fixing member 40, an aluminum material is preferable because it can be plastically deformed easily, but other materials may be used for the fixing member 40.

In order to install the microphone cord 30 in the support enclosure 20, after the microphone cord 30 has been inserted through the cord introduction hole 25 and the front end side thereof has been pulled out to the outside of the support enclosure 20, the fixing member 40 is fitted on the shield covering line exposure portion 33*a* of the microphone cord 30 and the sleeve 41 is staked, by which the microphone cord 30 is fixed.

After the power line 31 and the signal line 32 of the microphone cord have been soldered to a predetermined lead wire of the circuit board 21, the front end side of the microphone cord 30 is pulled into the support enclosure 20, and the outer periphery side of the fixing member 40 is brought into contact with the internal surface of the support enclosure 20.

Thereby, the microphone cord 30 is prevented from coming off, and also the shield covering line 33 is surely connected electrically to the support enclosure 20 via the fixing member 40. Therefore, a high-frequency current caused by strong electromagnetic waves applied to the microphone cord 30 flows to the support enclosure 20 side, and does not enter into the support enclosure 20, whereby the generation of noise due to electromagnetic waves is prevented.

In the example shown in FIG. 1, to enhance the fixation reliability of the fixing member 40, a suitable cushioning material 52 such as rubber is arranged on the fixing member 40, and a washer 51 frictionally engaging with the internal surface of the support enclosure 20 is fitted from the upside of the cushioning material 52, by which the fixing member 40 is pressed by the washer 51.

Next, an example shown in FIG. 2 is explained. In this example, internal threads 20*a* are formed in the internal surface of the support enclosure 20, and external threads 40*a* threadedly engaging with the internal threads 20*a* are formed in the outer peripheral surface of the fixing member 40, by which the fixing member 40 is screwed in the support enclosure 20. According to this configuration, the washer 51, which is used in the example shown in FIG. 1, is unnecessary, which accordingly reduces the cost and improves the assembling workability. Other constructions may be the same as those in the example shown in FIG. 1.

The present application is based on, and claims priority from, Japanese Application Serial Number JP2004-251656, filed Aug. 31, 2004, the disclosure of which is hereby incorporated by reference herein in its entirety.

The invention claimed is:

1. A condenser microphone having a condenser microphone unit, and a microphone cord with a two-core shield covering line, the condenser microphone unit including a microphone capsule, which contains a diaphragm and a backplate arranged so as to face each other in a cylindrical housing, and a cylindrical metallic support enclosure, which supports the microphone capsule on one end side and has a cord introduction hole on the other end side; a circuit board on which an impedance converter electrically connected to the backplate via predetermined conducting means is mounted is provided in the support enclosure, one end of the microphone cord being pulled into the support enclosure through the cord introduction hole and connected to the circuit board, wherein the microphone cord is provided with a shield covering line exposure portion, in which a shield covering line is stripped off, in a portion in which the microphone cord is pulled into the support enclosure, the shield covering being turned over the microphone cord; an annular fixing member having a diameter larger than that of the cord introduction hole is provided in the support enclosure for fixing the microphone cord to the microphone unit; at an inner periphery side of the fixing member, a sleeve is integrally formed with the annular fixing member and is disposed over a turned portion of the shield covering to be fixed thereto by plastic deformation in a radial direction, and an outer periphery side of the fixing member being connected electrically to the internal surface of the support enclosure.

2. The condenser microphone according to claim 1, wherein in the support enclosure, a washer is arranged which frictionally engages with the internal surface of the support enclosure and fixes the fixing member so as to press the fixing member.

3. The condenser microphone according to claim 1, wherein internal threads are formed in the internal surface of the support enclosure, and external threads threadedly engaging with the internal threads are formed in the outer peripheral surface of the fixing member, by which the fixing member is screwed in the support enclosure.

4. A condenser microphone, comprising:

a condenser microphone unit including a microphone capsule having a cylindrical housing, a diaphragm, and a backplate arranged so as to face each other in the cylindrical housing and having a circuit board thereon; and a cylindrical metallic support enclosure for supporting the microphone capsule on one end side and having a cord introduction hole on the other end side, a microphone cord having a plurality of lines connected to the circuit board, a shield covering for covering the lines, and a shield covering turned portion in which the shield covering is stripped off and turned over the lines so that the lines extend beyond the turned portion, and an annular fixing member attached to the other end side of the metallic support enclosure for fixing the microphone cord to the microphone unit, said annular fixing member having an outer periphery with a diameter larger than that of the cord introduction hole, said outer periphery being electrically connected to an internal surface of the support enclosure, and a sleeve integrally formed with the fixing member at an inner side thereof and being disposed over the turned portion of the shield covering to be fixed thereto with plastic deformation in a radial direction.

5. The condenser microphone according to claim 4, wherein said shield covering extends inside the metallic support enclosure and terminates at the turned portion fixed to the sleeve.

6. The condenser microphone according to claim 5, further comprising a washer arranged between the metallic support enclosure and the fixing member so as to press the fixing member.

* * * * *